United States Patent [19]

Inagaki et al.

[11] Patent Number: 4,484,873

[45] Date of Patent: Nov. 27, 1984

[54] THROUGH VANE TYPE ROTARY COMPRESSOR WITH SPECIFIC CHAMBER CONFIGURATION

[75] Inventors: Mitsuo Inagaki; Hideaki Sasaya, both of Okazaki, Japan

[73] Assignee: Nippon Soken, Inc., Nishio, Japan

[21] Appl. No.: 328,796

[22] Filed: Dec. 8, 1981

[30] Foreign Application Priority Data

Dec. 9, 1980 [JP] Japan ..... 55-174053
May 28, 1981 [JP] Japan ..... 56-79998

[51] Int. Cl.[3] ..... F04C 18/00; F04C 27/00
[52] U.S. Cl. ..... 418/150; 418/255
[58] Field of Search ..... 418/150, 255

[56] References Cited

U.S. PATENT DOCUMENTS

| | | | |
|---|---|---|---|
| 1,922,951 | 8/1933 | Hawley | 418/150 |
| 1,952,834 | 3/1934 | Beidler et al. | 418/150 |
| 2,165,963 | 7/1939 | Curtis | 418/150 |
| 2,397,098 | 3/1946 | Fowler | 418/150 |
| 2,491,351 | 12/1949 | Zeitlin | 418/150 |
| 4,373,880 | 2/1983 | Tanaka et al. | 418/150 |

*Primary Examiner*—John J. Vrablik

*Attorney, Agent, or Firm*—Cushman, Darby & Cushman

[57] ABSTRACT

The present invention relates to an improvement in the configuration of the inner face of a housing of a through vane type rotary compressor for use in a car cooler or the like, in which both the top ends of a vane passing through the center of a rotor are always kept in sliding contact with the inner face of the housing.

In the present invention, the configuration of the inner face of the housing is determined so that substantial face-to-face contact is produced between the rotor and the housing in a certain region with the point for contact with the rotor being as the center, and the configuration of the subsequent curved portion is defined by such a curve that the velocity of the sliding movement of the vane in the radial direction of the rotor is expressed by a gentle function where said velocity monotonously changes.

The through vane type rotary compressor of the present invention is improved over the conventional through vane type rotary compressor in the volumetric efficiency, and the through vane type rotary compressor of the present invention is very excellent in the low-noise and low-vibration characteristics.

2 Claims, 13 Drawing Figures

THROUGH VANE TYPE ROTARY COMPRESSOR WITH SPECIFIC CHAMBER CONFIGURATION

BRIEF SUMMARY OF INVENTION

1. Field of the Invention

The present invention relates to a through vane type rotary compressor, more particularly, to a configuration of the inner face of a housing of a through vane type rotary compressor adapted to, for example, a car cooler, in which both the top ends of a sliding block passing through the center of a rotor are always kept in sliding contact with the inner face of a housing.

2. Description of the Prior Art

In a conventional through vane type rotary compressor, the configuration of the inner face of a housing is ordinarily defined by a limaçon curve expressed by the formula $R(\theta)=r+d-d\cos\theta$ with the center of a rotor being regarded as the center of the polar coordinates. In this formula, d stands for an optional constant and r stands for the radius of the rotor.

In such a conventional through vane type rotary ccmpressor, the high pressure and low pressure sides are separated from each other at the point of $\theta=0$, that is, the point of R=r where the housing contacts the rotor, and leakage of a cooling medium from the high pressure side to the low pressure side is prevented only by a linear seal at this contact point. In consideration of thermal expansion or deviation of the rotation center, a clearance of about 0.02 to about 0.03 mm is provided between the rotor and housing at the contact point. Accordingly, a cooling medium or the like leaks from the high pressure side to the low pressure side through this clearance, resulting in reduction of the volumetric efficiency.

OBJECT AND SUMMARY OF THE INVENTION

The present invention is to overcome the foregoing defect involved in the conventional through vane type rotary compressor. According to the present invention, there is provided a through vane type rotary compressor in which the configuration of the inner face of a housing is arranged so that it is not defined by the above-mentioned limaçon curve but by a specific curve different from the limaçon curve, whereby leakage of a fluid such as a cooling medium from the high pressure side to the low pressure side is prevented and the volumetric efficiency is therefore enhanced.

According to the present invention, the inner face of a housing is formed to have such a profile that the housing has substantial face-to-face contact with a rotor within a certain region with the contact point between the rotor and housing being as the center, and the subsequent curved region has such a shape as to gradually change the sliding speed of a vane in the radial direction. It has been found that when the inner face of the housing is formed to such a specific configuration, leakage of a cooling medium is prevented and the volumetric efficiency is enhanced, and there can be provided a through vane type rotary compressor excellent in low-vibration and low-noise characteristics.

It is a primary object of the present invention to provide a through vane type rotary compressor excellent in low-vibration and low-noise characteristics, in which the inner face of a housing is formed to have a special profile or configuration, whereby the volumetric efficiency is enhanced.

Another object of the present invention is to provide a through vane type rotary compressor having a very high volumetric efficiency, in which the inner face of the housing is formed to have an arcuate shape having a radius equal to the radius of a rotor within a certain region with the contact point between the rotor and housing being as the center and the rotor is caused to fall in face-to-face contact with the housing in this region, whereby leakage of a fluid from an extrusion port to a suction port is prevented.

Still another object of the present invention is to provide a through vane type rotary compressor excellent both in low-noise and low-vibration characteristics and in durability, in which the inner face of a housing is formed to have such a profile as to gradually change the sliding speed of a sliding block in the radial direction of a rotor, whereby abnormal friction of the vane and the inner face of the housing is prevented.

A further object of the present invention is to provide a through vane type rotary compressor having a high volumetric efficiency, in which the inner face of a housing is formed to have such a configuration that the pressing load of a vane on the inner face of the housing is promptly and abruptly increased with rotation of a rotor, whereby leakage of a fluid over a relatively broad region as occurring in a housing having an inner edge of a profile defined by the limaçon curve is prevented.

A still further object of the present invention is to provide a through vane type compressor having a high volumetric efficiency and being excellent in low-noise and low-vibration characteristics, in which the inner face of a housing is formed to have a configuration defined by such a single curve that the acceleration of a vane is a synthesis of sine waves, whereby leakage of a fluid is prevented.

Other objects and features of the present invention will become apparent from the detailed description given hereinafter with reference to preferred embodiments illustrated in the accompanying drawings.

BRIEF DESCRIPTION OF THE DRAWINGS

FIG. 2 and FIG. 3 show the principle of creating the configuration of a inner face of a housing in the embodiment shown in FIG. 1, in which FIG. 2 illustrates the relation among the housing, rotor, and vane and FIG. 3 illustrates the acceleration, speed, and displacement of the vane during rotation of the rotor.

DETAILED DESCRIPTION OF THE PREFERRED EMBODIMENTS

Figure 1:
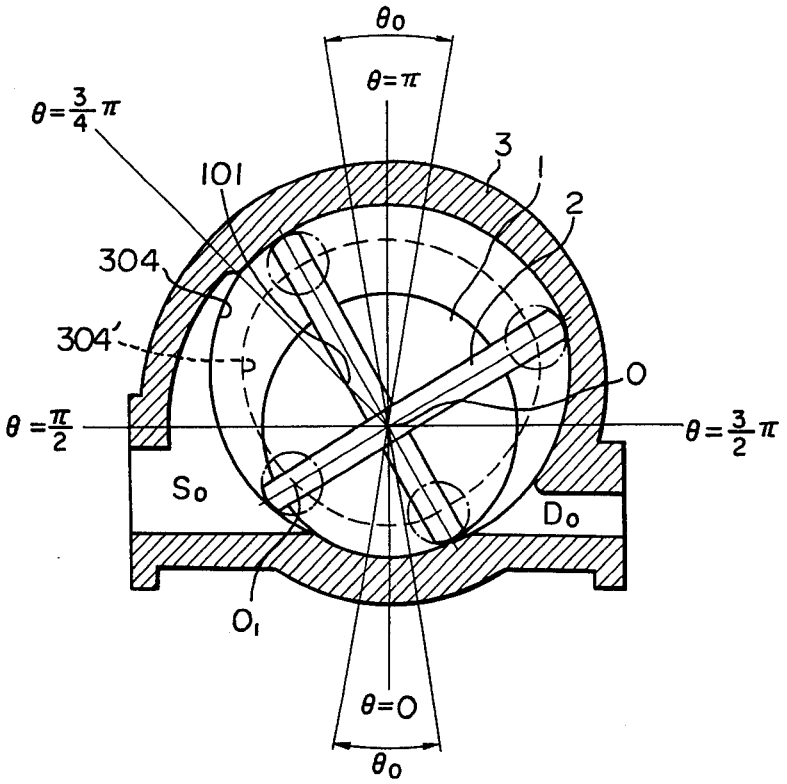
FIG. 1 is a view showing the longitudinal section of a through vane type rotary compressor according to one preferred embodiment of the present invention.

The structure of the present invention will now be described with reference to a first embodiment illustrated in FIG. 1.

Reference numeral 1 represents a rotor having two slits 101 passing through the center O of rotation, reference numeral 2 represents a vane arranged slidably in the two slits of the rotor 1 in the radial direction, and reference numeral 3 represents a housing having the inner face 304 having a configuration according to the present invention, which configuration comprises two small and large arcuate portions covering a region $\theta_o$ with the points of $\theta=0°$ and $\theta=180°$ being as the centers, respectively, and a very gradual line connecting said two arcuate portions. A suction port $S_o$ is opened to the position of $\theta=\frac{3}{4}\pi$ in an operation space defined by the rotor 2 and inner edge 304 of the housing 3. $D_o$ represents a discharge port.

The principle of creating the configuration of the inner face of the housing in the present embodiment will now be described with reference to FIGS. 2 and 3.

Figure 2:
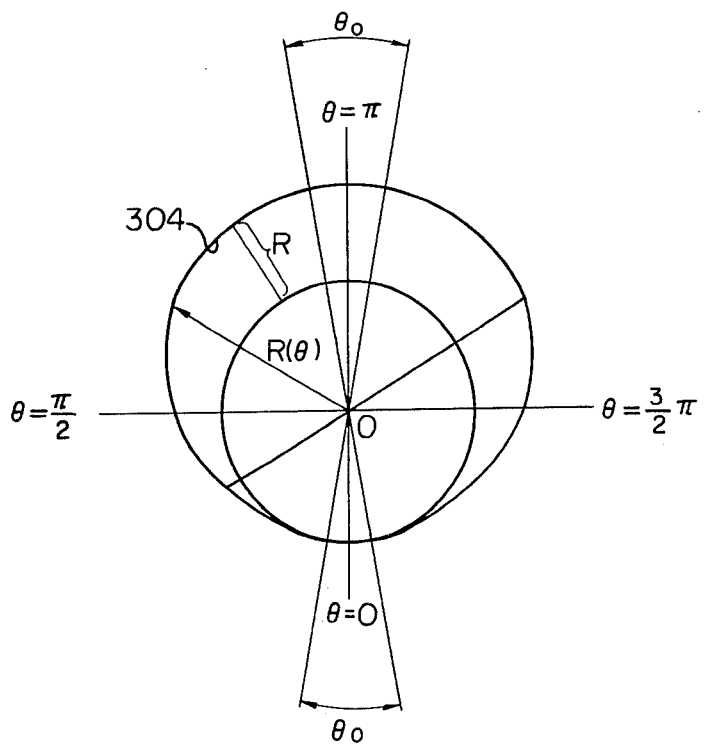
Figure 3:
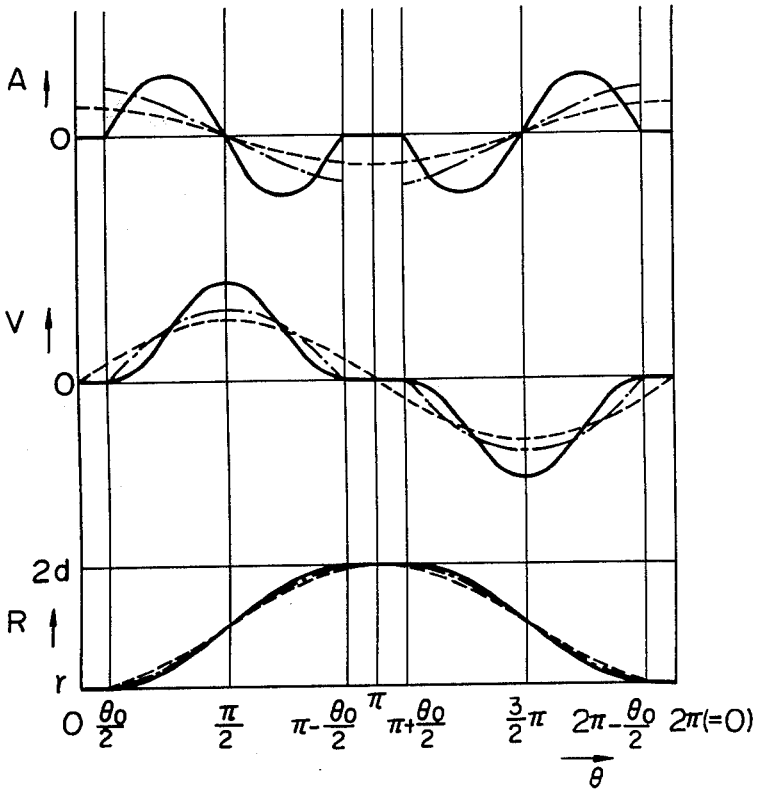

In FIG. 3, $\theta=0\sim2\pi$ (one rotation of the rotor) shown in FIG. 2 is plotted on the abscissa, and the acceleration A of the sliding movement of the vane in the radial direction with rotation of the rotor, the velocity V of this sliding movement and the quantity R of projection of the top end of the vane over the radius of the rotor, that is, the displacement R of the configuration of the inner face of the housing over the radius of the rotor, are plotted on the ordinate. In FIG. 3, solid lines concern the configuration of the inner face of the housing according to the present embodiment. Since the configuration of the inner face of the housing has arcuate portions in regions of $\theta=0\sim\theta_o/2$, $\theta=\pi-\theta_o/2\sim\pi+\theta_o/2$, and $\theta=2\pi-\theta_o/2\sim2\pi$, the displacement R becomes 0 in regions of $\theta=0\sim\theta_o/2$ and $\theta=2\pi-\theta_o/2\sim2\pi$, and the maximum quantity of projection of the vane is 2d in the region of $\theta=\pi-\theta_o/2\sim\pi+\theta_o/2$. Accordingly, in the above region, the velocity V is 0 and also the acceleration A is 0. The locus connecting the points of R=0 and R=2d in the region of $\theta=\theta_o/2\sim\pi-\theta_o/2$ is a very gradual curve which is obtained by integrating the acceleration A changed like a sine wave and further integrating the obtained gradient velocity V which monotonously increases in the region of $\theta=\theta_o/2\sim\pi/2$ and monotonously decreases in the region of $\theta=\pi/2\sim\pi-\theta_o/2$. Furthermore, the locus connecting the points of R =2d and R=0 in the region of $\theta=\pi+\theta_o/2\sim2\pi-\theta_o/2$ is a very gradient curve obtained by integrating twice the acceleration A changed like a sine wave while reversing the positive and negative signs adopted above in the region $\theta=\theta_o/2\sim\pi-\theta_o/2$.

The conventional configuration of the inner face of the housing defined by the above-mentioned limaçon curve is shown by a broken line in FIG. 3. It is seen that in the region of $\theta=\pi/2\sim3/2\pi$, the value of the acceleration A in the configuration of the inner face of the housing according to the present embodiment is larger than that according to the limaçon curve.

The configuration of the inner face 304 of the housing in the present embodiment may be expressed by the following formulae relative to the distance R($\theta$) from the center O of rotation:

$$R(\theta) = r \text{ in the regions of } \theta = 0 \sim \theta_o/2 \text{ and } \theta = 2\pi - \theta_o/2 \sim 2\pi,$$

$$R(\theta) = r + 2d \text{ in the region of } \theta = \pi - \theta_o/2 \sim \pi + \theta_o/2,$$

$$R(\theta) = -\frac{d}{\pi}\sin\left(\frac{2\pi}{\pi-\theta_o}\right)(\theta-\theta_o/2) + \frac{2d}{\pi-\theta_o}(\theta-\theta_o/2) + r \text{ in the region of } \theta = \theta_o/2 \sim \pi - \theta_o/2,$$

and $$R(\theta) = \frac{d}{\pi}\sin\left(\frac{2\pi}{\pi-\theta_o}\right)(\theta-\pi-\theta_o/2) + \frac{2d}{\pi-\theta_o}(2\pi-\theta_o/2-\theta) + r \text{ in the region of } \theta = \pi + \theta_o/2 \sim 2\pi - \theta_o/2.$$

Accordingly, the sum $\Sigma R(\theta)$ of R($\theta$) at the position deviated by $\pi(\frac{1}{2}$ rotation) from an optional rotation angle $\theta$ of the rotor is expressed in the regions of $\theta=0\sim\theta_o/2$ and $\theta=\pi-\theta_o/2\sim\pi$ as follows:

$$\Sigma R(\theta)=r+r+2d=2r+2d$$

and in the region of $\theta=\theta_o/2\sim\pi-\theta_o/2$ as follows:

$$\begin{aligned}\Sigma R(\theta) &= -\frac{d}{\pi}\sin\left(\frac{2\pi}{\pi-\theta_o}\right)(\theta-\theta_o/2) + \frac{2d}{\pi-\theta_o}(\theta-\theta_o/2) + r \\ &\quad + \frac{d}{\pi}\sin\left(\frac{2}{\pi-\theta_o}\right)(\theta+\pi-\pi-\theta_o/2) + \frac{2d}{\pi-\theta_o}(2\pi-\theta_o/2-\theta-\pi) + r \\ &= 2r + 2d\end{aligned}$$

Thus, it will readily be understood that $\Sigma R(\theta)$ is always equal to the length of the vane.

In the foregoing description of the principle of creating the configuration of the inner face 304 of the housing, the vane 2 has been explained as a segment of a line for facilitating understanding. In a practical through vane type rotary compressor, however, as shown in FIG. 1, the vane has a certain thickness, and an arc having a central point $O_1$ on the central line of the thickness is formed on the top end of the vane. The central point $O_1$ of the arc on the top end moves along the locus 304' created according to the above-mentioned principle with rotation of the rotor 1, and an outer envelope curve which is drawn by circles having the same radius as that of the top end arc along the locus of the movement of the central point $O_1$ of the top end arc so that a part of the top end arc is always kept in sliding contact with the inner face of the housing defines the inner face configuration 304 of the housing.

Figure 4:
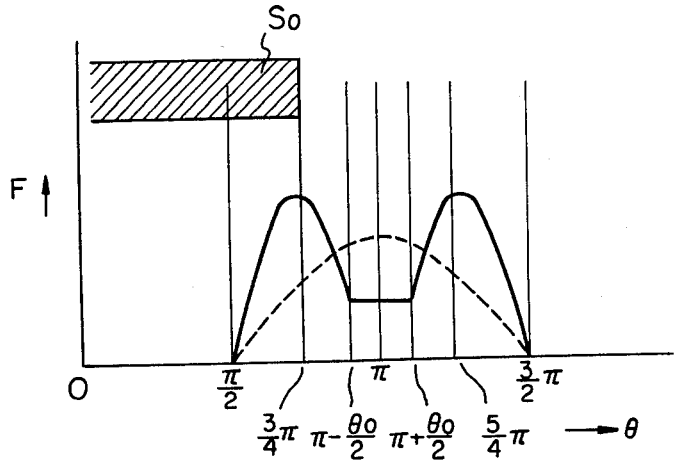
FIG. 4 is a diagram comparing the embodiment shown in FIG. 1 with the conventional through vane type rotary compressor with respect to the pressing load of the vane on the housing.

In the present embodiment, as indicated by a solid line in FIG. 4, the pressing load F of the vane 2 on the inner face 304 of the housing can substantially be expressed by the following formula:

$$F=m(E\cdot\omega^2-A)$$

wherein A stands for the acceleration for the reciprocative movement of the vane in the rotor slit 101 in the radial direction, E stands for the distance between the centroid of the vane 2 and the center O of rotation of the rotor 1, m stands for the mass of the vane 2, and $\omega$ stands for the angular velocity of the rotor 1.

In the region of $\theta=\pi/2\sim3/2\pi$, the vane 2 slides while pressing the inner face of the housing with the load F.

In contrast, the load F imposed on the inner face of the conventional housing having the configuration defined by the limaçon curve is as shown by a broken line in FIG. 4. From FIG. 4, it is seen that in case of the inner face configuration according to the present embodiment, rising of the load from $\theta=\pi/2$ is more rapid and the value of the load F is larger than in case of the conventional inner face configuration.

As is apparent from the foregoing description, in the conventional through vane rotary compressor, the vane 2 slides with the pressing load on the inner face of the housing only during $\frac{1}{2}$ rotation of $\theta=\pi/2\sim3/2\pi$ where the above-mentioned acceleration has a negative sign. Accordingly, in the actual manufacture of such a through vane type rotary compressor, a minute clearance is formed between the vane and the inner face of the liner, and in the region other than the above-mentioned region of $\theta=\pi/2\sim3/2\pi$, leakage of a fluid occurs at the top end portion of the vane and reduction of the volumetric efficiency is caused.

In the present embodiment, since two vanes are used and rising of the loner-pressing load is rapid, the top end of the vane 2 assuredly presses the inner face of the housing up to the point of $\theta=\frac{3}{4}\pi$ where the suction port indicated $S_o$ in FIG. 4 is closed, and as pointed out hereinbefore, the value of the acceleration A is larger in case of the inner face configuration of the housing according to the present embodiment (see FIG. 3) than in case of the conventional inner face configuration and the above-mentioned load F is increased within the region of $\frac{1}{4}$ rotation of $\theta=\frac{3}{4}\pi\sim5/4\pi$. Accordingly, there is no substantial leakage of the fluid at the top end portion of the vane. Moreover, as pointed out hereinbefore, the inner face of the housing has an arcuate portion having the same radius as that of the rotor in the region of $\theta_o$ with the point of $\theta=0$ being as the center and falls in face-to-face contact with the rotor in this region. Therefore, leakage of the fluid from the extrusion port $D_o$ to the suction port $S_o$ does not occur. Accordingly, a very high volumetric efficiency can be attained in the through vane type rotary compressor according to the present embodiment.

Furthermore, since there is no extreme change of the pressing load of the vane on the inner face of the housing, both the vibration and noise are low, and since there is no abnormal friction of the vane and housing, the durability is enhanced.

Figure 5:
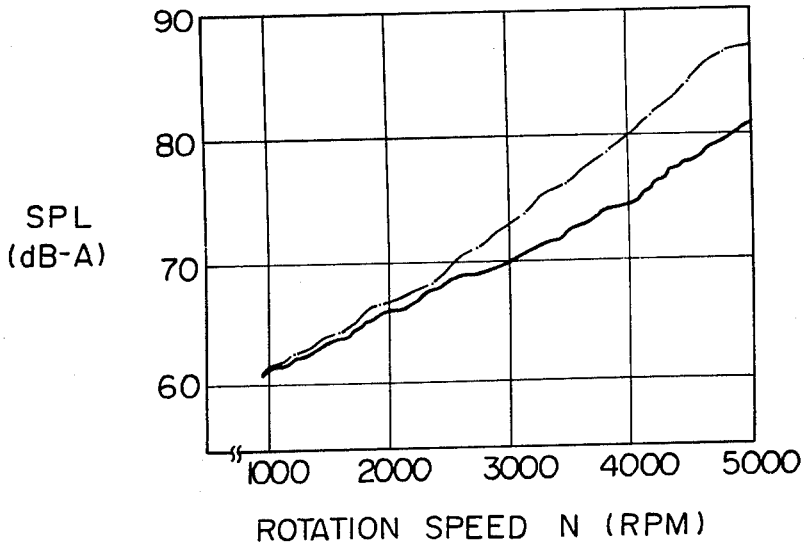
FIG. 5 is a diagram comparing the embodiment shown in FIG. 1 with the conventional through vane type rotary compressor with respect to the noise level.

It has been confirmed that the through vane type rotary compressor having the housing inner face configuration according to the present embodiment has a volumetric efficiency higher by at least 5% than the volumetric efficiency of the through vane type rotary compressor having the known housing inner face configuration defined by the limaçon curve. It has also been confirmed that with respect to the noise level, as shown in FIG. 5, the housing inner face configuration according to the present embodiment (solid line in FIG. 5) shows at the time of high rotation speed a noise lower by at least 5 dB than the noise (one-dot chain line in FIG. 5) of the housing inner face configuration of a curve gradually connecting the above two large and small arcs, for example, one expressed by the formula $$R = r + d - d\sin\frac{\pi}{\pi-\theta o}(\theta-\pi/2),$$

which is obtained when a sine wave-like change is made in the region of $\theta=\theta_o/2\sim\pi-\theta_o/2$ as indicated by a one-dot chain line in FIG. 3.

The fact that the arcuate portions are connected by a gradual curve means that the inclination of the tangential line on the terminal end of the arcuate portion is equal to the inclination of the tangential line on the contact point of the curve. However, this does not mean that the inclination per se of the tangential line is gradually changed. This point will now be described.

When both the arcs are connected by a curve of $$R = r + d - d\sin\frac{\pi}{\pi-\theta o}(\theta-\pi/2),$$

indicated by a one-dot chain line in FIG. 3, the inclination of the tangential line on the curve is expressed as follows:

$$\frac{dR}{d\theta} = -d\frac{\pi}{\pi-\theta o}\cos\frac{\pi}{\pi-\theta o}(\theta-\pi/2)$$

At the terminal end of the arcuate portion, $$\left(\frac{dR}{d\theta}\right)_{\theta=\theta o/2} = 0$$

is established because $\theta$ is equal to $\theta_o/2$, and in the arcuate portion, $dR/d\theta=0$ is always established. Accordingly, at the point of $\theta=\theta_o/2$, the curve is gradually connected to the arcuate portion.

However, the change of the inclination of the tangential line corresponds to further differentiation of $dR/d\theta$. On the above-mentioned curve, this quadratic differentiation is expressed as follows:

$$\frac{d^2R}{d\theta^2} = d\left(\frac{\pi}{\pi-\theta_o}\right)^2\sin\frac{\pi}{\pi-\pi_o}(\theta-\pi/2)$$

and at the point of $\theta=\theta_o/2$, the quadratic differentiation is expressed as follows:

$$\frac{d^2R}{d\theta^2} = d\left(\frac{\pi}{\pi-\theta_o}\right)^2 \neq 0$$

In the arcuate portion, the quadratic differentiation is expressed as follows:

$$d^2R/d\theta^2=0$$

Therefore, both the quadratic differentiations are not in agreement with each other. Namely, the inclination per se of this tangential line does not gradually change. Incidentally, $$d^2R/d\theta^2$$

indicates not only the change of the inclination of the tangential line but also the velocity V of the sliding movement of the vane in the radial direction. Accordingly, the fact that the above value does not gradually change means that the sliding velocity abruptly changes, resulting in generation of noise.

With respect to the curve of the present embodiment, which is represented by the following formula:

$$R(\theta) = -\frac{d}{\pi}\sin\left(\frac{2\pi}{\pi-\theta_o}\right)(\theta-\theta_o/2) + \frac{2d}{\pi-\theta_o}(\theta-\theta_o/2)+r$$

a similar confirmation will now be made. The inclination of the tangential line on the curve is expressed as follows:

$$\frac{dR}{d\theta} = -\frac{d}{\pi}\,\frac{2\pi}{\pi-\theta_o}\cos\left(\frac{2\pi}{\pi-\theta_o}\right)(\theta-\theta_o/2)+\frac{2d}{\pi-\theta_o}$$

at point of $\theta=\theta_o/2$, the relation of $$\left(\frac{dR}{d\theta}\right)_{\theta=\theta_o/2} = -\frac{2d}{\pi-\theta_o}+\frac{2d}{\pi-\theta_o}=0$$

is established. The quadratic differentiation is expressed as follows:

$$\frac{d^2R}{d\theta^2} = \frac{d}{\pi}\left(\frac{2\pi}{\pi-\theta_o}\right)^2\sin\left(\frac{2\pi}{\pi-\theta_o}\right)(\theta-\theta_o/2)$$

At the point of $\theta=\theta_o/2$, the quadratic differentiation is expressed as follows:

$$\left(\frac{d^2R}{d\theta^2}\right)_{\theta=\theta_o/2}=0$$

Accordingly, this curve is connected to the terminal end of the arcuate portion while R is gradually changed, and also the velocity V of the sliding movement gradually changes.

In the above-mentioned first embodiment of the present invention, the portion connecting the two small and large arcuate portions of the inner face configuration of the housing is formed to have a shape obtained by integrating twice the acceleration A changed like a sine wave as indicated by A in FIG. 3. In the second embodiment of the present invention, as indicated by a solid line in FIG. 6, the inner face of the housing is formed to have a configuration obtained by changing the acceleration like a triangular wave.

In this second embodiment, in the region of $\theta=0\sim\theta_o/2$, R is equal to r (R=r), and in the region of $$\theta = \theta o/2 \sim \frac{\pi+\theta o}{4},$$

R is expressed as follows:

$$R = \frac{d}{6\left(\frac{\pi-\theta o}{4}\right)^3}(\theta-\theta o/2^3+r$$

In the region of $$\theta = \frac{\pi+\theta o}{4}\sim\pi/2,$$

R is expressed as follows:

$$R = \frac{-32d}{3(\pi-\theta o)^3}(\theta-\pi/2)^3+\frac{4d}{\pi-\theta o}\theta-d\frac{\pi+\theta o}{\pi-\theta o}+r$$

Figure 6:
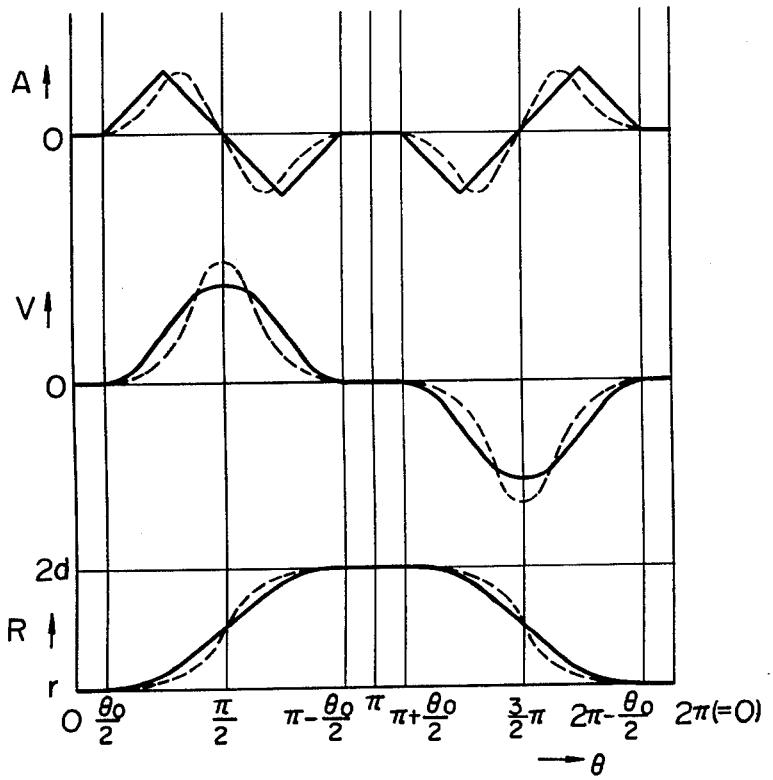
FIG. 6 is a diagram similar to FIG. 3, which illustrates the principle of creating the configuration of an inner face of a housing in a second embodiment of the present invention.

Also in this embodiment, as shown in FIG. 6, the velocity V gradually increases monotonously and decreases monotonously.

The third embodiment of the present invention will now be described with reference to FIGS. 7 through 13.

Figure 7:
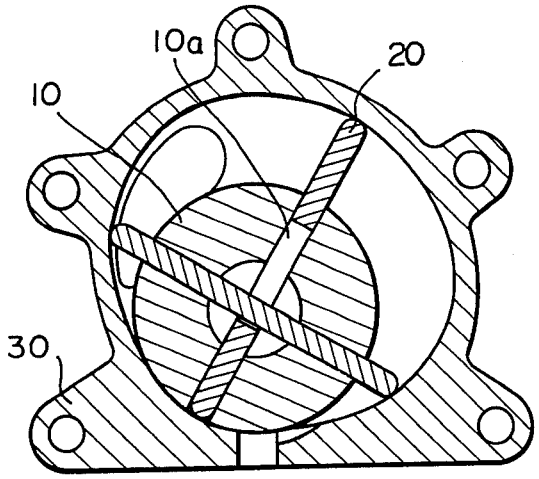
FIG. 7 is a view showing the longitudinal section of a through vane type rotary compressor according to a third embodiment of the present invention.

In FIG. 7, reference numeral 10 represents a rotor having two slits 10*a* passing through the center of rotation, and a vane 20 is arranged so that it can slide in the two slits 10*a* of the rotor 10 in the radial direction. Reference numeral 30 represents a housing having an inner face configuration defined according to the present invention. Both the top ends of the vane 20 are caused to fall in sliding contact with the inner circumferential face of the housing 30.

Figure 8:
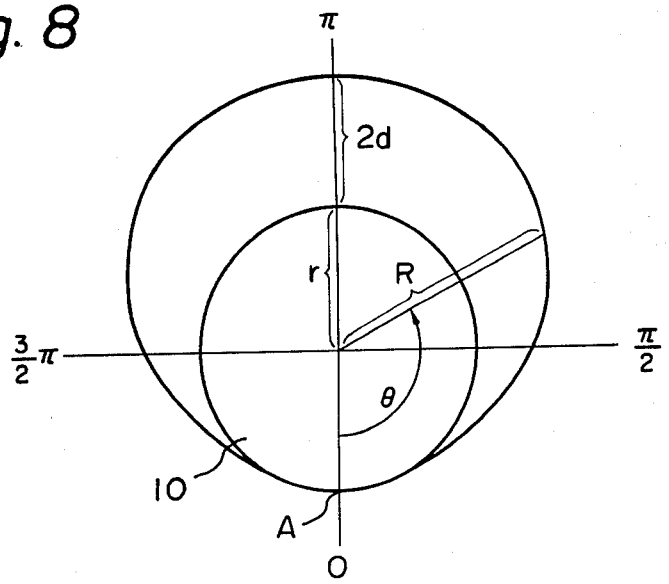
FIG. 8 is a diagram illustrating the configuration of the inner face of a housing of the compressor shown in FIG. 7.

FIG. 8 shows the inner face configuration of the housing according to the present embodiment. In FIG. 8, r represents the radius of the rotor and 2d represents the maximum quantity of projection of the vane. The inner face configuration of the housing 30 is determined so that the acceleration $\ddot{R}$ of the relative sliding movement of the vane 20 to the slit 10*a* of the rotor 10 is expressed by the following formula:

$$\ddot{R} = Cl\,w^2(\cos\theta-\cos3\theta)$$
$$= Cl\,w^2(\cos\omega t-\cos3\omega t)$$

wherein $\theta$ stands for the angle of rotation, with the proviso that the point of $\theta=0$ designates the point A, C1 stands for the constant, $\omega$ stands for the angular velocity, and t designates the time.

The above formula is integrated with respect to the time t to determine the relative velocity $\dot{R}$ of the vane 20 in the slit 10*a* of the rotor 10. This relative velocity $\dot{R}$ is expressed as follows:

$$\dot{R} = Cl\omega^2\left(\frac{1}{\omega}\sin\omega t - \frac{1}{3\omega}\sin 3\omega t\right) + C2$$

Since $\dot{R}$ is 0 when $\theta$ is zero, C2 is 0 in the above formula.

The above formula is integrated again with respect to the time t to determine the locus of the top end of the vane 20, that is, the inner face configuration R of the housing 30. The inner face configuration R is expressed as follows:

$$R = -Cl\omega^2\left(\frac{1}{\omega^2}\cos\omega t - \frac{1}{9\omega^2}\cos 3\omega t\right) + C3$$

Since R is equal to r (R=r) when $\theta$ is 0 and since R is equal to r+2d ($R=r+2d$) when $\theta$is equal to $\pi$, C1 is expressed as C1=9/8d and C3 is expressed as $C3=d+r$. Therefore, the inner face configuration of the housing 30 is expressed as follows:

$$R = -\frac{9}{8}d\omega^2\left(\frac{1}{\omega^2}\cos\omega t - \frac{1}{9\omega^2}\cos 3\omega t\right) + d + r$$

$$= -\frac{9}{8}d\left(\cos\theta - \frac{1}{9}\cos 3\theta\right) + d + r$$

Furthermore, the acceleration of the sliding movement of the vane 20 sliding along this inner face configuration of the housing 30 while having contact therewith is expressed as follows:

$$\ddot{R} = \frac{9}{8}dw^2(\cos\theta - \cos 3\theta)$$

Figure 9:
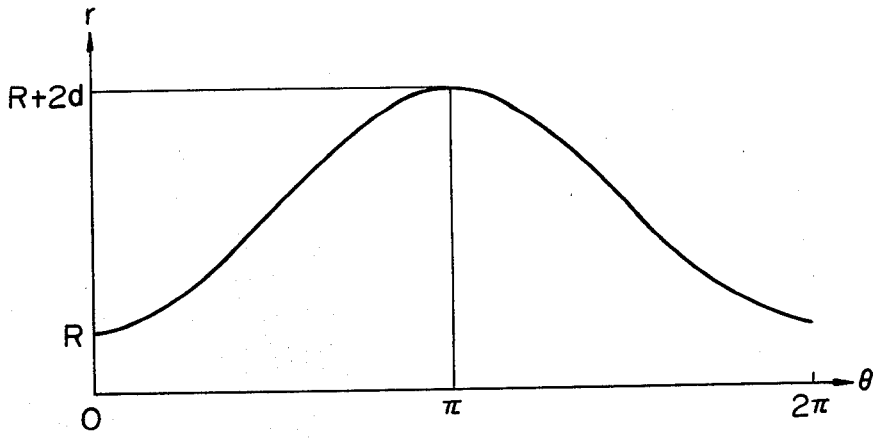
FIG. 9 is a diagram illustrating the change of the radius vector of the inner face of the housing shown in FIG. 8.
Figure 10:
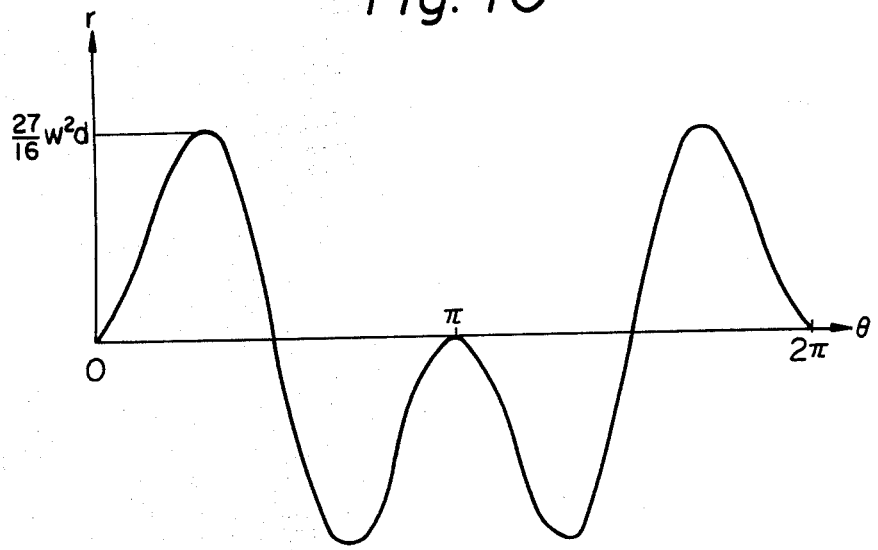
FIG. 10 is a diagram illustrating the acceleration of a vane of the compressor shown in FIG. 7.

These curves are as shown in FIGS. 9 and 10.

Figure 11:
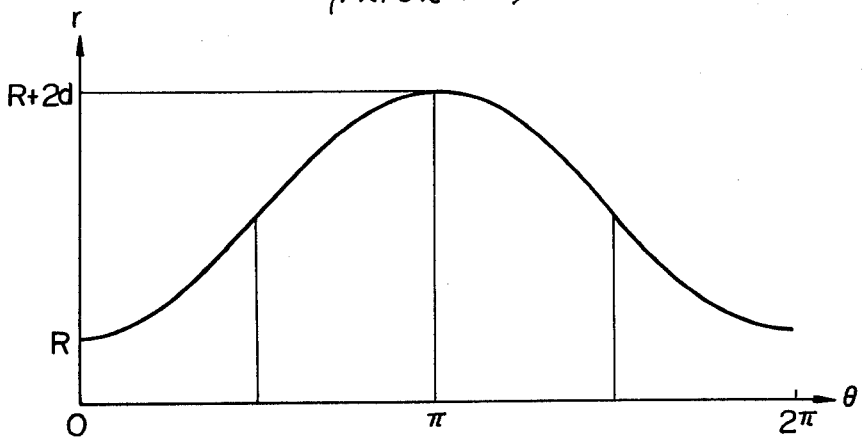
Fig. 11 (PRIOR ART)
FIG. 11 is a diagram illustrating the change of the radius vector of an inner face of a housing in the conventional through vane type rotary compressor.
Figure 12:
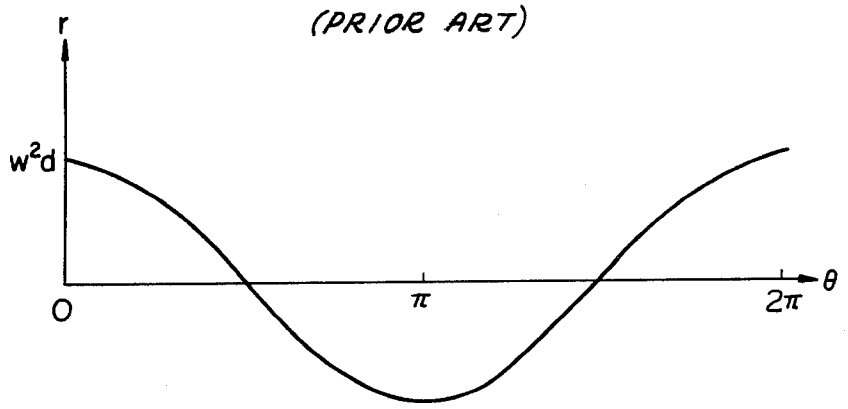
Fig. 12 (PRIOR ART)
FIG. 12 is a diagram illustrating the acceleration of a vane in the conventional through vane type rotary compressor.
Figure 13:
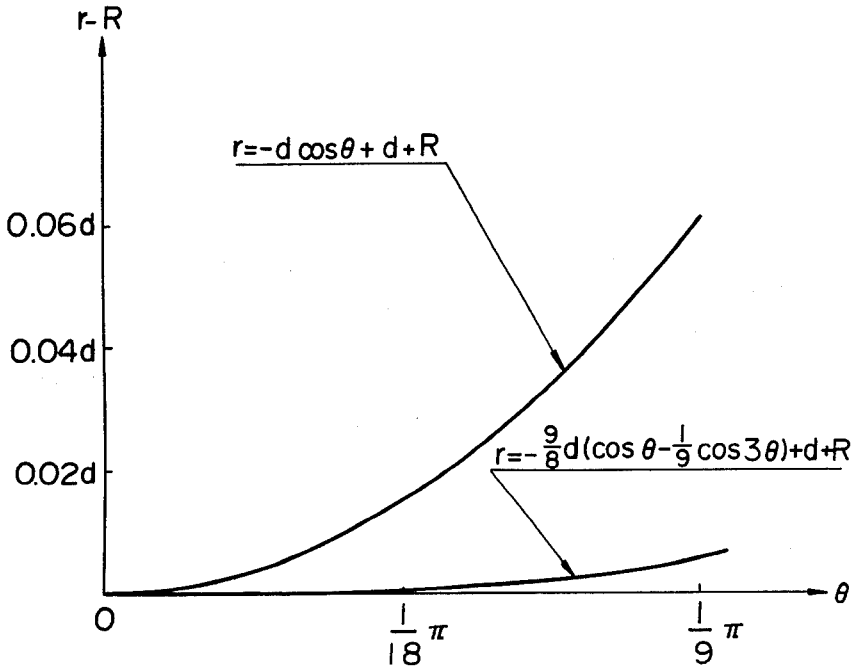
FIG. 13 is a diagram illustrating the inner face of the housing of the compressor shown in FIG. 7 while comparing it with the inner face of the housing of the conventional through vane type rotary compressor.

FIGS. 11 and 12 illustrate the inner face configuration of a housing having the conventional inner face configuration defined by the limaçon curve having a radius vector R and the acceleration of the sliding movement of a vane sliding within this housing while having contact with the inner face thereof. When FIG. 11 is compared with FIG. 9, the difference is not seemingly prominent. However, if the vicinity of the point of $\theta=0$, that is, the vicinity of the point A of contact between the inner face of the housing 30 and the rotor, is shown in an enlarged manner as in FIG. 13, the difference of the change of the radius vector R becomes conspicuous. More specifically, in the case where the through vane type rotary compressor according to the present embodiment and the conventional through vane type rotary compressor have the same dimensions (r=26 mm, d=$\delta$ mm), if both the compressors are compared with respect to the region where the clearance between the housing 30 and the rotor 10 is less than 0.01 mm, it is seen that in the compressor according to the present embodiment this region covers 28° while the region covers only 6° in the conventional compressor. From this fact, it will readily be understood that in the compressor according to the present embodiment, substantial face-to-face contact is produced between the housing 30 and the rotor 10, and by virtue of this face-to-face contact, leakage of a fluid such as a cooling medium from the high pressure side to the low pressure side can substantially be reduced, with the result that the volumetric efficiency can remarkably be enhanced. Furthermore, since the slit 10*a* is formed on the peripheral face of the rotor 10, in the conventional configuration where a linear seal is produced between the housing 30 and the rotor 10, even this linear seal is lost when this rotor slit 10*a* passes through the point A, resulting in increase of leakage of the cooling medium or the like. In contrast, according to the present embodiment, since a seal length longer than the width of the open face of the rotor slit 10*a* is guaranteed, leakage of the cooling medium through the open face of the rotor slit 10, which is often observed in the conventional through vane type compressor, is not caused to occur.

Moreover, in the present embodiment, since the inner face configuration of the housing 30 is determined so that the acceleration $\ddot{R}$ of the vane becomes equal to $C1\omega^2(\cos\theta - \cos 3\theta)$, attainment of the noise-reducing effect as well as the above-mentioned sealing effect can be expected at the point A. More specifically, the frequency components possessed by the acceleration of the vane 20 with rotation of the rotor 10 are only $\cos\theta(\cos\omega t)$ and $\cos 3\theta(\cos 3\omega t)$, that is, low frequency components determined by $\omega/2\pi$ and $3\omega/2\pi$, and the acceleration of the sliding block 20 has no high frequency components causing a problem of noises. Therefore, according to the present embodiment, there can be provided a through vane type rotary compressor excellent in low-noise characteristics.

The housing inner face configuration of the above-mentioned third embodiment may be combined with a configuration having an arcuate face in the region of $\theta=0\sim\theta_o/2$, so that there is formed a housing inner face configuration characterized by R=r in the region of $$\theta = 0 \sim \theta/2 \text{ and } -\frac{9}{8}d\left\{\cos\frac{\pi}{\pi-\theta o}(\theta-\theta o/2) + \frac{1}{9}\cos\frac{3\pi}{\pi-\theta o}(\theta-\theta o/2)\right\} + d + r \text{ in the region of } \theta = \theta o/2 \sim \pi - \theta o/2.$$

Also in this modification, as shown by a broken line in FIG. 6, the velocity V of the sliding movement of the vane in the radial direction is allowed to gradually increase monotonously and decrease monotonously as in the foregoing first and second embodiments. Furthermore, over a range of $\frac{1}{4}$ rotation, that is, a region where the rotation angle $\theta$ of the rotor is in the range of from $\frac{3}{4}\pi$ to $5/4\ \pi$, the vane makes a sliding movement while it is pressed to the inner face of the housing with a sufficient load. Therefore, the above-mentioned effects attained in the foregoing embodiments can similarly be attained also in this modification.

Incidentally, it must be noted that the wave form of the acceleration is not limited to those illustrated hereinbefore in the respective embodiments.

We claim:

1. A through vane type rotary compressor comprising a housing having a suction port and a discharge port and having a cylindrical inner face; a rotor rotatably mounted within said housing, drive means for rotating said rotor, said rotor being arranged within said housing eccentrically from the center of the housing so that said rotor contacts said cylindrical inner face within the housing at one point; said rotor including at least one vane having a predetermined length, said rotor having means defining at least one slit extending radially outwardly from the center of said rotor, said at least one vane being arranged slidably in said rotor slit means so as to pass through the center of said rotor and extend radially outwardly from opposite sides of said rotor thereby defining two top ends of said at least one vane which are always kept in contact with the inner face of said housing, wherein the volume between the rotor and the inner face of said housing is changed with rotation of said rotor, said through vane type rotary compressor being characterized in that the configuration of the inner face of the housing is defined by a curve such that the relative acceleration $\ddot{R}$ of said at least one vane to said rotor is expressed by the following formula:

$$\ddot{R}=C1\omega^2(\cos\theta-\cos 3\theta)$$

wherein Cl stands for a constant, $\omega$ represents the angular velocity and $\theta$ represents the rotation angle.

2. A through vane type rotary compressor comprising:

housing means for enclosing said compressor, said housing including means defining a hollow interior chamber together with suction and discharge ports on opposite sides of said interior chamber, rotor means rotatably mounted within said interior chamber, said rotor means including an eccentrically mounted rotor, said rotor being in contact with said housing at one predetermined spot, said rotor means including at least one vane having a predetermined length, said rotor including means defining at least one slit extending therethrough and arranged to pass through the center of said rotor, said at least one vane being slidably engaged within said at least one slit so that both ends thereof remain in contact with the interior surface of said chamber, wherein the volume between the rotor and the interior surface of said chamber is changed with rotation of the rotor, and wherein the configuration of the inner surface of said chamber is defined by a curve such that the relative acceleration R of said at least one vane to said rotor is expressed by the following formula:

$$\ddot{R}=C1\omega^2(\cos\theta-\cos 3\theta)$$

wherein Cl stands for a constant, $\omega$ represents the angular velocity and $\theta$ represents the rotation angle so that a minimum increasing clearance from said contact spot exists between said rotor and said housing along an arc extending for about 28° in the region adjacent the point where the angle of rotation $\theta$ equals zero.

* * * * *